US011588227B1

(12) United States Patent
Sissoev et al.

(10) Patent No.: US 11,588,227 B1
(45) Date of Patent: Feb. 21, 2023

(54) FOUR-ELEMENT PHASED ARRAY ANTENNA

(71) Applicant: AEROANTENNA TECHNOLOGY, INC., Chatsworth, CA (US)

(72) Inventors: Alex Sissoev, Chatsworth, CA (US); Joseph Klein, Chatsworth, CA (US)

(73) Assignee: AEROANTENNA TECHNOLOGY, INC., Chatsworth, CA (US)

( * ) Notice: Subject to any disclaimer, the term of this patent is extended or adjusted under 35 U.S.C. 154(b) by 0 days.

(21) Appl. No.: 17/467,642

(22) Filed: Sep. 7, 2021

(51) Int. Cl.
*H01Q 1/28* (2006.01)
*H01Q 3/34* (2006.01)

(52) U.S. Cl.
CPC ..... *H01Q 1/28* (2013.01); *H01Q 3/34* (2013.01)

(58) Field of Classification Search
CPC ..... H01Q 3/34; H01Q 1/28
See application file for complete search history.

(56) References Cited

U.S. PATENT DOCUMENTS

| | | | | |
|---|---|---|---|---|
| 9,368,879 | B1 * | 6/2016 | Manry, Jr. | H01Q 21/26 |
| 10,862,199 | B1 * | 12/2020 | Zhang | H01Q 1/283 |
| 2016/0218439 | A1 * | 7/2016 | Fasenfest | H01Q 21/08 |
| 2020/0395672 | A1 * | 12/2020 | Rogers | H01Q 9/0428 |

* cited by examiner

*Primary Examiner* — Awat M Salih
(74) *Attorney, Agent, or Firm* — Burr & Forman, LLP

(57) ABSTRACT

An aviation antenna assembly may include a base portion for operably coupling the antenna assembly to an aircraft body, a support platform, and a plurality of antenna elements including a first antenna element, a second antenna element, a third antenna element, and a fourth antenna element. The support platform may be operably coupled to the base portion to support each of the first, second, third and fourth antenna elements uniformly distributed about a central axis. The support platform may support the first antenna element opposite the third antenna element relative to the central axis, and support the second antenna element opposite the fourth antenna element relative to the central axis. A line intersecting a center of the first and third antenna elements may form a 45° angle relative to a line of symmetry passing through the antenna assembly.

9 Claims, 3 Drawing Sheets

FOUR-ELEMENT PHASED ARRAY ANTENNA

TECHNICAL FIELD

Example embodiments generally relate to antennas and, in particular, relate to a structure and geometry for a four-element phased array antenna for aircraft μ-wave communication systems.

BACKGROUND

Modern aircraft rely on various radio links with end points being air-to-ground, air-to-air, or air-to-satellite. Some such links are satellite communication links including low earth orbit (LEO) satellite communication systems. LEO satellite constellations give the advantage of full global coverage with no dead spots in satellite visibility probability density function. However, one of the main attributes of LEO systems is that both of the end points (i.e., the satellite and the aircraft) are moving, and not stationary. If the maximum link quality is required, the satellite and aircraft antenna beam patterns have to be directed toward each other. In the case of non-stationary end points, this will require dynamically adjustable antenna beam patterns.

BRIEF SUMMARY OF SOME EXAMPLES

In an example embodiment, an aviation antenna assembly may be provided. The antenna assembly may include a base portion for operably coupling the antenna assembly to an aircraft body, a support platform, and a plurality of antenna elements including a first antenna element, a second antenna element, a third antenna element, and a fourth antenna element. The support platform may be operably coupled to the base portion to support each of the first, second, third and fourth antenna elements uniformly distributed about a central axis. The support platform may support the first antenna element opposite the third antenna element relative to the central axis, and support the second antenna element opposite the fourth antenna element relative to the central axis. A line intersecting a center of the first and third antenna elements may form a 45° angle relative to a line of symmetry passing through the antenna assembly.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
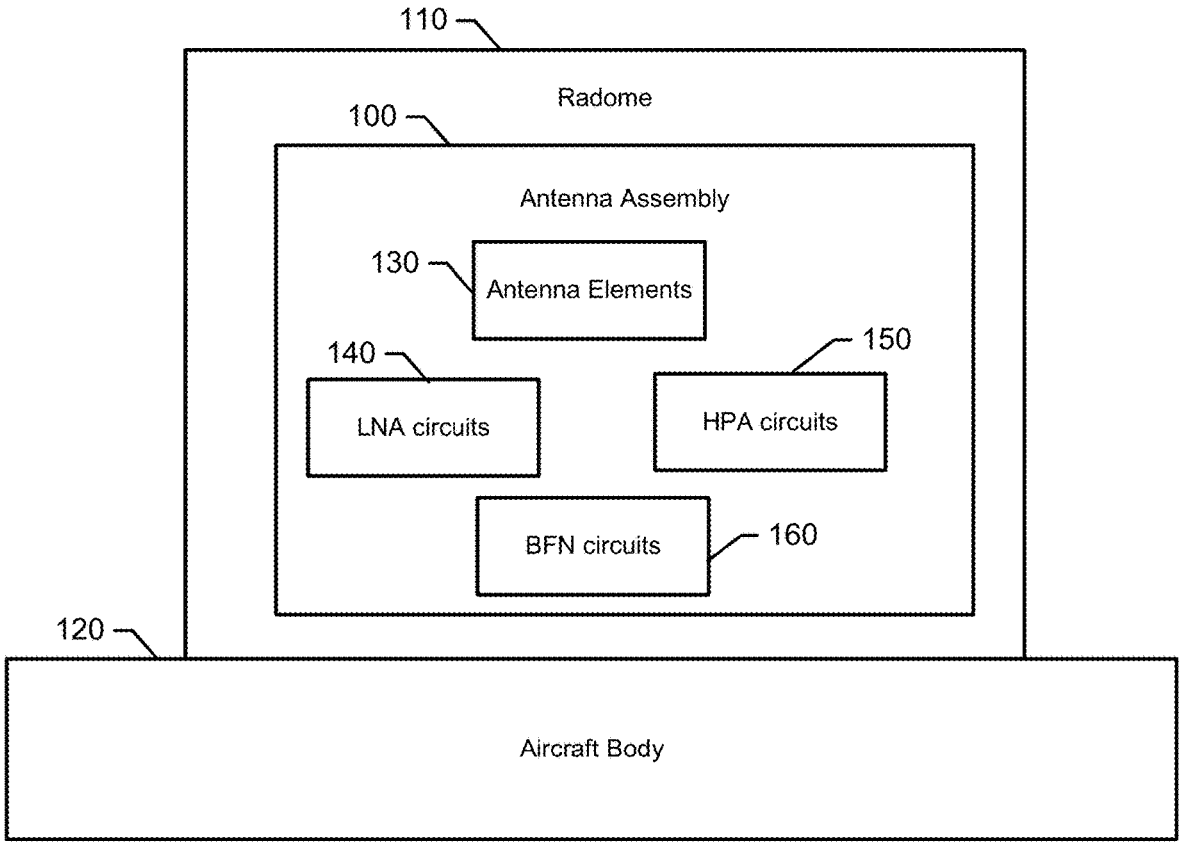
FIG. 1 illustrates a block diagram of an antenna assembly of an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As noted above, in a communications context where the end points are moving, it is important that the antenna beam patterns of both the aircraft and the other moving end point (e.g., satellite) are able to be directed toward each other to maximize link quality. Meanwhile, aircraft applications also tend to require reduced physical antenna dimensions to be employed so that merely increasing passive antenna gain is not a viable solution in many cases. Because of this limitation, it is necessary to achieve a balance between passive antenna gain and active signal amplification. In terms of hemispherical angles, θ, and a probability distribution function, f(θ), the probability density function for LEO satellites can be approximated as:

$$pdf(\theta) = \int_{\theta}^{\theta_M} f_{\theta,\theta_{MAX}}(\theta, \theta_{MAX})d\theta_{MAX}.$$

The probability density function shown above peaks at about 20° elevation (over horizon). In addition, the aircraft body presents a ground plane that alters antenna beam radiation patterns. This fact must therefore be considered for optimal phased array beam forming, along with the above mentioned constraints on physical size of the antenna. Additionally, reduction in physical antenna dimensions and shape constraints for aerodynamic considerations must also be balanced.

In an antenna array, the array factor (AF) is a figure that describes the radiation intensity in, or toward, a certain direction (angle), and can be described mathematically, for a 4-element array as:

$$AF(\theta, \phi) = \sum_{n=1}^{4} a_n e^{j(n-1)\left(\hat{k}(\theta,\phi)d\cos\gamma+\beta\right)},$$

where θ=90°−elevation, and ϕ=azimuth, and where $a_n$ and β are the amplitude and phase excitation coefficients, respectively, γ is the array axis angle, d is the distance between the array elements, and k is the wave vector [k=k(azimuth, elevation), for 3-D space], which describes the direction of the signal (wave) propagation. For the described application, it is desirable to maximize the AF in the current, dynamically changing, direction of the LEO satellite relative to the aircraft antenna. To achieve dynamic AF reconfiguration, dynamic phased array controls can be used. However, it is also beneficial as well as practical, to employ an antenna that is structured to provide optimal characteristics. In this regard, for example, providing an antenna that has an optimized array axis angle, γ, optimized element geometry, and optimized dimensions of the antenna may make the dynamic phased array control much simpler and more effective. Example embodiments may therefore provide a structure for an antenna assembly 100 that achieves these objectives, as shown by the exemplary structures described below.

Referring now to FIG. 1, an antenna assembly 100 of an example embodiment is shown. The antenna assembly 100 may include constituent modules or sub-assemblies that are all placed inside a single radome 110 for placement on the external surface of an aircraft body 120. The aircraft body 120 may be a portion of a fuselage of an aircraft, or a wing or other component or surface disposed on the aircraft. In an example embodiment, the constituent modules or sub-assemblies of the antenna assembly 100 may include antenna elements 130, low noise amplifier (LNA) circuits 140, high power amplifier (HPA) circuits 150 and beam forming network (BFN) circuits 160. The LNA circuits 140, HPA circuits 150 and BFN circuits 160 may operate under electronic control to form and/or steer beams toward the LEO satellite. However, the structure of the antenna elements 130 themselves may be optimized to simplify or otherwise improve such control. An example structure for the antenna elements 130 of the antenna assembly 100 according to an example embodiment are shown in greater detail in FIGS. 2-4.

Figure 2:
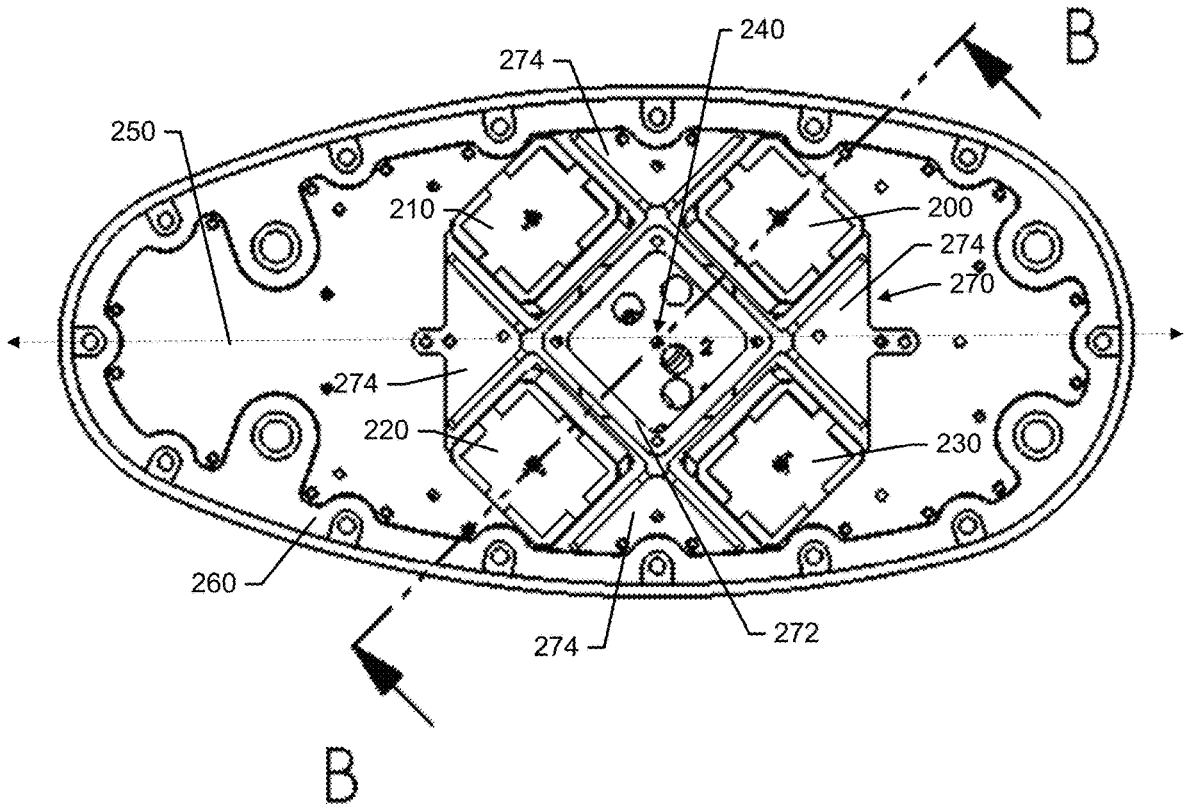
FIG. 2 illustrates a top view of the antenna assembly of an example embodiment.
Figure 3:
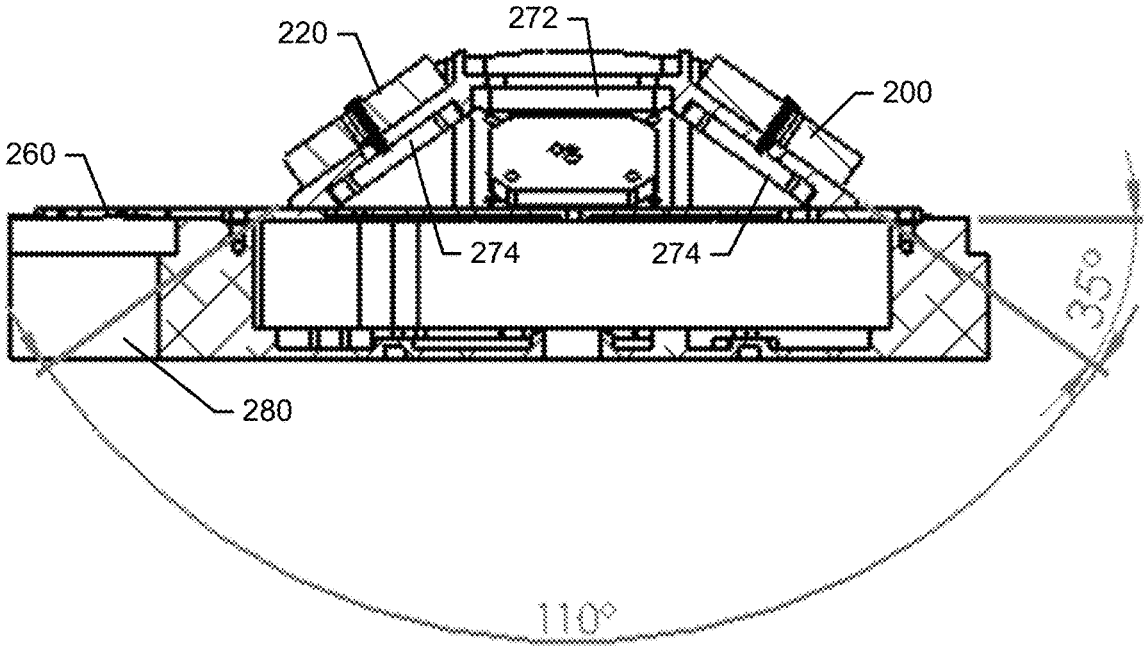
FIG. 3 illustrates a cross section view of the antenna assembly taken along line B-B of FIG. 2 of an example embodiment.
Figure 4:
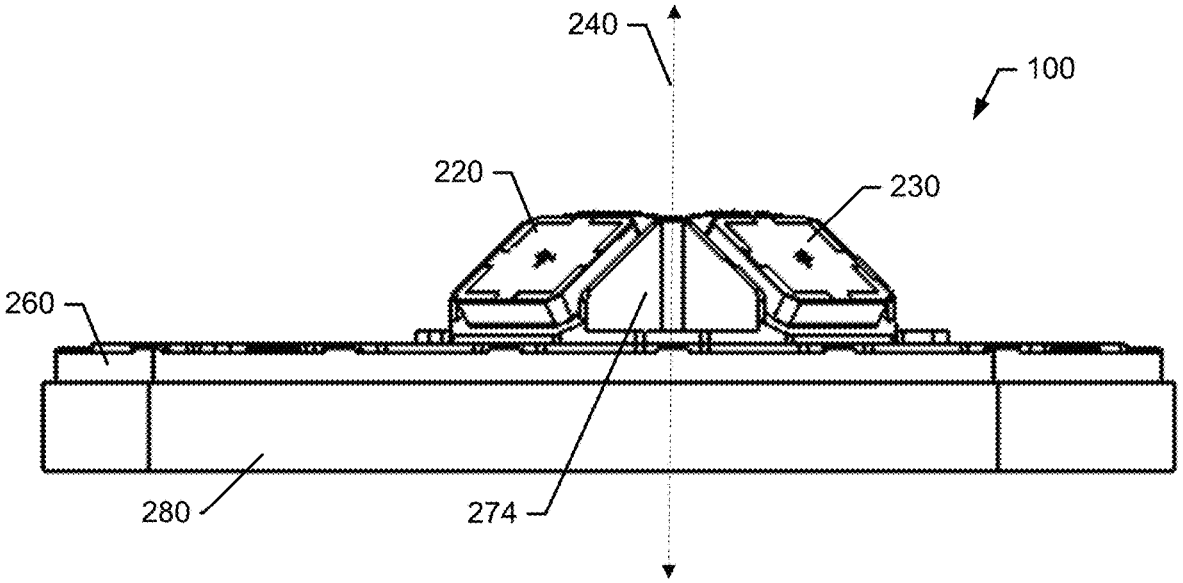
FIG. 4 illustrates a side view of the antenna assembly of FIG. 2 in accordance with an example embodiment.

Referring now to FIGS. 2-4, the antenna elements 130 of FIG. 1 may include a first antenna element 200, a second antenna element 210, a third antenna element 220 and a fourth antenna element 230. The first, second, third and fourth antenna elements 200, 210, 220 and 230 may each have a substantially planar face and, in this example, may have a substantially rectangular (or square) lateral periphery defining the form factor of each antenna element. Thus, each of the first, second, third and fourth antenna elements 200, 210, 220 and 230 may be a substantially square shaped, plate-like component having a relatively thin thickness. The first, second, third and fourth antenna elements 200, 210, 220 and 230 may be uniformly placed around a central axis 240, such that a line (e.g., line B-B) intersecting the centers of either of the two opposing antenna elements is at a 45° angle relative to a line of symmetry 250 passing through the antenna assembly 100.

The antenna assembly 100 may include a base portion 260, which may include a mounting bracket for mounting the base portion to a ground plane 280 of the aircraft (e.g., aircraft body 120 of FIG. 1). The base portion 260 may be operably coupled to all of the electronics associated with the LNA circuits 140, HPA circuits 150 and BFN circuits 160, and the radome 110 may attach to the base portion 260.

The antenna assembly 100 may also include a support platform 270 to which each of the first, second, third and fourth antenna elements 200, 210, 220 and 230 is mounted in the manner described above. In this regard, the support platform 270 may include a center scaffold 272 having a general external shape of a rectangular prism. The center scaffold 272 may be disposed at a center of the support platform 270. Meanwhile, respective ramp portions 274 may be formed at respective corners of the center scaffold 272. The ramp portions 274 may have a triangular ramp shape extending from the base portion 260 toward a top of the center scaffold 272 proximate to edges of each of the antenna elements. Thus, the ramp portions 274 effectively combine to provide four distributed platforms upon which each of the first, second, third and fourth antenna elements 200, 210, 220 and 230 can respectively be mounted. The ramp portions 274 may define a 35° angle relative to the base portion 260 (and the ground plane 280). Accordingly, an angle defined between planes in which opposing ones of the first, second, third and fourth antenna elements 200, 210, 220 and 230 may be about 110°.

In an example embodiment, the specific sizes of the center scaffold 272 and the ramp portions 274 may depend on the sizes of the antenna elements, which may in turn be sized according to the operating frequency range of the antenna assembly 100. In example embodiments designed for aircraft μ-wave communication systems and/or LEO satellite communications, a length of the center scaffold 272 (as measured from the base portion 260 along the central axis 240) may be less than three inches. Thus, for example, if the length of the center scaffold 272 is about three inches, then a length (and width) dimension of each of the first, second, third and fourth antenna elements 200, 210, 220 and 230 may extend in a range of between about 4.5 to 5.2 inches, since the length of the hypotenuse of each of the ramp portions 274 may be about 5.2 inches.

Based on the descriptions above, it can be appreciated that an aviation antenna assembly of an example embodiment may include a plurality of antenna elements. The antenna assembly may also include a base portion for operably coupling the antenna assembly to an aircraft body, and a support platform. The plurality of antenna elements may include a first antenna element, a second antenna element, a third antenna element, and a fourth antenna element. The support platform may be operably coupled to the base portion to support each of the first, second, third and fourth antenna elements uniformly distributed about a central axis. The support platform may support the first antenna element opposite the third antenna element relative to the central axis, and support the second antenna element opposite the fourth antenna element relative to the central axis. A line intersecting a center of the first and third antenna elements may form a 45° angle relative to a line of symmetry passing through the antenna assembly.

In some embodiments, the antenna assembly may include additional components/modules, optional features, and/or the components/features described above may be modified or augmented. Some examples of modifications, optional features and augmentations are described below. It should be appreciated that the modifications, optional features and augmentations may each be added alone, or they may be added cumulatively in any desirable combination. For example, a second line intersecting a center of the second and fourth antenna elements may form a 45° angle relative to the line of symmetry passing through the antenna assembly. In an example embodiment, the support platform may include a center scaffold having a substantially rectangular prism shape, and a ramp portion disposed between lateral sides of each of the first, second, third and fourth antenna elements. In some cases, the center scaffold may extend less than three inches away from the base portion along the central axis. In an example embodiment, the ramp portions may define a hypotenuse forming a 35° angle relative to the base portion. In some cases, an angle between a plane of an exterior surface of the first antenna element may form about a 110° angle relative to a plane of an exterior surface of the third antenna element. In an example embodiment, the hypotenuse may have a length of between about 4.5 inches and about 5.2 inches. In some cases, each of the first, second, third and fourth antenna elements may have a square periphery with sides of the square having a length of between about 4.5 inches to about 5.2 inches. In an example embodiment, the center scaffold may have a square shaped top portion having a length of each side between about 4.5 to 5.2 inches. In some cases, adjacent respective lines extending from the central axis to a center of each of the first, second, third and fourth antenna elements may be separated from each other by 90°.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An aviation antenna assembly comprising:

a base portion for operably coupling the antenna assembly to an aircraft body;

a plurality of antenna elements including a first antenna element, a second antenna element, a third antenna element, and a fourth antenna element; and a support platform operably coupled to the base portion to support each of the first, second, third and fourth antenna elements uniformly distributed about a central axis, wherein the support platform supports the first antenna element opposite the third antenna element relative to the central axis, and supports the second antenna element opposite the fourth antenna element opposite each other relative to the central axis, wherein a line intersecting a center of the first and third antenna elements forms a 45° angle relative to a line of symmetry passing through the antenna assembly, and wherein the support platform comprises a center scaffold having a substantially rectangular prism shape, and a ramp portion disposed between lateral sides of each of the first, second, third and fourth antenna elements.

2. The antenna assembly of claim 1, wherein a second line intersecting a center of the second and fourth antenna elements forms a 45° angle relative to the line of symmetry passing through the antenna assembly.

3. The antenna assembly of claim 1, wherein the center scaffold extends less than three inches away from the base portion along the central axis.

4. The antenna assembly of claim 3, wherein the ramp portions define a hypotenuse forming a 35° angle relative to the base portion.

5. The antenna assembly of claim 4, wherein an angle between a plane of an exterior surface of the first antenna element forms about a 110° angle relative to a plane of an exterior surface of the third antenna element.

6. The antenna assembly of claim 4, wherein the hypotenuse has a length of between about 4.5 inches and about 5.2 inches.

7. The antenna assembly of claim 4, wherein each of the first, second, third and fourth antenna elements has a square periphery with sides of the square having a length of between about 4.5 inches to about 5.2 inches.

8. The antenna assembly of claim 7, wherein the center scaffold has a square shaped top portion having a length of each side between about 4.5 to 5.2 inches.

9. The antenna assembly of claim 1, wherein adjacent respective lines extending from the central axis to a center of each of the first, second, third and fourth antenna elements are separated from each other by 90°.

* * * * *